US005525169A

United States Patent [19]

Murtha

[11] Patent Number: 5,525,169

[45] Date of Patent: Jun. 11, 1996

[54] CORROSION RESISTANT ALUMINUM ALLOY ROLLED SHEET

[75] Inventor: Shawn J. Murtha, Monroeville, Pa.

[73] Assignee: Aluminum Company of America, Pittsburgh, Pa.

[21] Appl. No.: 241,124

[22] Filed: May 11, 1994

[51] Int. Cl.[6] ..... C22F 1/04; C22C 21/08

[52] U.S. Cl. ..... 148/695; 148/552; 148/692; 148/693; 148/696; 148/697; 148/700; 148/417; 148/439; 420/534; 420/537; 420/538; 420/543; 420/547

[58] Field of Search ..... 148/552, 692, 148/693, 695, 696, 697, 700, 417, 439, 534, 537, 538, 546, 547

[56] References Cited

U.S. PATENT DOCUMENTS

| | | | |
|---|---|---|---|
| 4,000,007 | 12/1976 | Develay et al. | 148/523 |
| 4,082,578 | 4/1978 | Evancho et al. | 148/535 |
| 4,174,232 | 11/1979 | Lenz et al. | 148/552 |
| 4,424,084 | 1/1984 | Chisholm | 148/417 |
| 4,525,326 | 6/1985 | Schwellinger et al. | 420/535 |
| 4,589,932 | 5/1986 | Park | 148/690 |
| 4,614,552 | 9/1986 | Fortin et al. | 148/417 |
| 4,718,948 | 1/1988 | Komatsubara et al. | 148/552 |
| 4,784,921 | 11/1988 | Hyland et al. | 148/417 |
| 4,808,247 | 2/1989 | Komatsubura et al. | 148/552 |
| 4,814,022 | 3/1989 | Constant et al. | 148/552 |
| 4,840,852 | 6/1989 | Hyland et al. | 148/417 |
| 4,897,124 | 1/1990 | Matsuo et al. | 148/552 |
| 5,266,130 | 11/1993 | Uchida et al. | 148/552 |

FOREIGN PATENT DOCUMENTS

| | | |
|---|---|---|
| 0480402 | 4/1992 | European Pat. Off. . |
| 0480402A1 | 4/1992 | European Pat. Off. . |

*Primary Examiner*—David A. Simmons
*Assistant Examiner*—Robert R. Koehler
*Attorney, Agent, or Firm*—David W. Pearce-Smith

[57] ABSTRACT

A process for fabricating an aluminum alloy rolled sheet particularly suitable for use for an automotive body, the process comprising: (a) providing a body of an alloy comprising: about 0.8 to about 1.5 wt. % silicon, about 0.2 to about 0.65 wt. % magnesium, about 0.02 to about 0.1 wt. % copper, about 0.01 to about 0.1 wt. % manganese, about 0.05 to about 0.2 wt. % iron; and the balance being substantially aluminum and incidental elements and impurities; (b) working the body to produce a the sheet; (c) solution heat treating the sheet; and (d) rapidly quenching the sheet. In a preferred embodiment, the solution heat treat is preformed at a temperature greater than 860° F. and the sheet is quenched by a water spray. The resulting sheet has an improved combination of formability, strength and corrosion resistance.

29 Claims, 1 Drawing Sheet

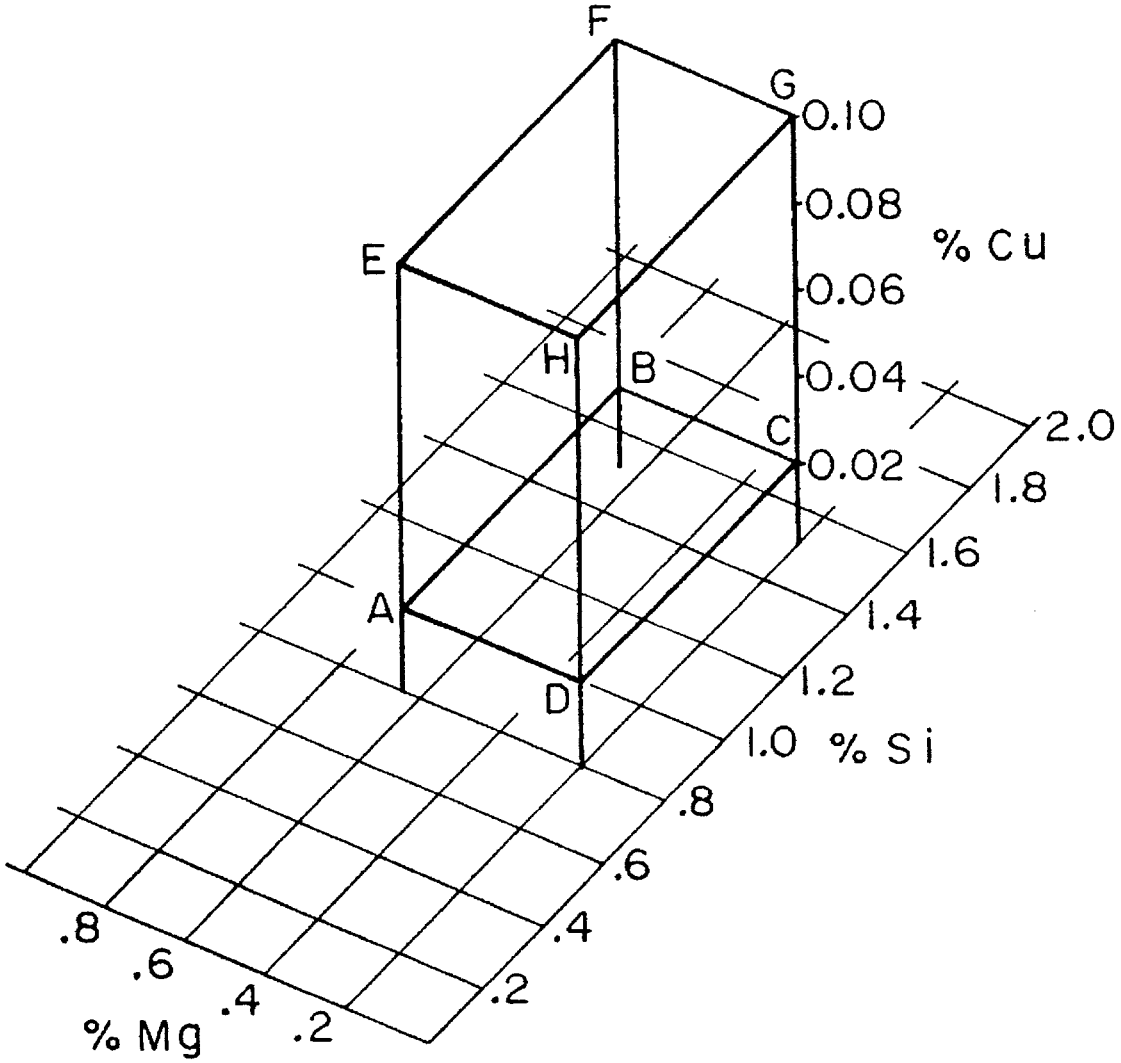
F
G
0.10
0.08
% Cu
E
0.06
H
B
0.04
C
2.0
0.02
1.8
1.6
A
1.4
1.2
D
1.0
% Si
.8
.6
.4
.2
.8
.6
.4
.2
% Mg

CORROSION RESISTANT ALUMINUM ALLOY ROLLED SHEET

TECHNICAL FIELD

The present invention relates to an aluminum alloy rolled sheet for forming and a production process therefor. More particularly, the present invention relates to an aluminum alloy rolled sheet for forming, which is suitable for applications in which a good formability, high strength and corrosion resistance are required and which has been subjected to paint baking, such as in an application for an automobile body.

BACKGROUND ART

Because of the increasing emphasis on producing lower weight automobiles in order, among other things, to conserve energy, considerable effort has been directed toward developing aluminum alloy products suited to automotive application. Especially desirable would be a single aluminum alloy product useful in several different automotive applications. Such would offer scrap reclamation advantages in addition to the obvious economies in simplifying metal inventories. Yet, it will be appreciated that different components on the automobile can require different properties in the form used. For example, an aluminum alloy sheet when formed into shaped outside body panels should be capable of attaining high strength which provides resistance to denting as well as being free of Lueders' lines, whereas the strength and the presence or absence of such lines on inside support panels, normally not visible, is less important. Lueders' lines are lines or markings appearing on the otherwise smooth surface of metal strained beyond its elastic limit, usually as a result of a multi-directional forming operation, and reflective of metal movement during that operation. Bumper applications on the other hand require such properties as high strength, plus resistance to denting and to stress corrosion cracking and exfoliation corrosion, usually together with receptiveness to chrome plating. To serve in a wide number of automotive applications, an aluminum alloy product needs to possess good forming characteristics to facilitate shaping, drawing, bending and the like, without cracking, tearing, Lueders' lines or excessive wrinkling or press loads, and yet be possessed of adequate strength. Since forming is typically carried out at room temperature, formability at room or low temperatures is often a principal concern. Still another aspect which is considered important in automotive uses is weldability, especially resistance spot weldability. For example, the outside body sheet and inside support sheet of a dual sheet structure such as a hood, door or trunk lid are often joined by spot welding, and it is important that the life of the spot welding electrode is not unduly shortened by reason of the aluminum alloy sheet so as to cause unnecessary interruption of assembly line production, as for electrode replacement. Also, it is desirable that such joining does not require extra steps to remove surface oxide, for example. In addition, the alloy should have high bending capability without cracking or exhibiting orange peel, since often the structural products are fastened or joined to each other by hemming or seaming.

Various aluminum alloys and sheet products thereof have been considered for automotive applications, including both heat treatable and non-heat treatable alloys. Heat treatable alloys offer an advantage in that they can be produced at a given lower strength level in the solution treated and quenched temper which can be later increased by artificial aging after the panel is shaped. This offers easier forming at a lower strength level which is thereafter increased for the end use. Further, the thermal treatment to effect artificial aging can sometimes be achieved during a paint bake treatment, so that a separate step for the strengthening treatment is not required. Non-heat treatable alloys, on the other hand, are typically strengthened by strain hardening, as by cold rolling. These strain or work hardening effects are usually diminished during thermal exposures such as paint bake or cure cycles, which can partially anneal or relax the strain hardening effects.

Accordingly, it would be advantageous to provide sheet materials having a combination of formability, strength and corrosion resistance.

The primary object of the present invention is to provide a method for forming an aluminum sheet product and having a combination of formability, strength and corrosion resistance.

Another objective of the present invention is to provide a composition that it capable of being formed into an aluminum sheet product which has considerably improved characteristics, particularly in formability, strength and corrosion resistance.

These and other objects and advantages of the present invention will be more fully understood and appreciated with reference to the following description.

SUMMARY OF THE INVENTION

In accordance with the present invention there is provided a process for fabricating an aluminum alloy rolled sheet particularly suitable for use for an automotive body, the process comprising: (a) providing a body of an alloy comprising: about 0.8 to about 1.5 wt. % silicon, about 0.2 to about 0.65 wt. % magnesium, about 0.01 to about 0.1 wt. % copper, about 0.01 to about 0.1 wt. % manganese, about 0.05 to about 0.2 wt. % iron; and the balance being substantially aluminum and incidental elements and impurities; (b) working the body to produce the sheet; (c) solution heat treating the sheet; and (d) rapidly quenching the sheet. The solution heat treating of the aluminum alloy sheet can be performed (a) at a temperature greater than about 860° F.; and (b) in the temperature range of about 860° to 1125° F. The sheet has an improved formability, strength and corrosion resistance.

In a preferred embodiment, the composition includes about 0.95 to about 1.35 wt. % silicon, about 0.3 to about 0.6 wt. % magnesium, about 0.04 to about 0.08 wt. % copper, about 0.02 to about 0.08 wt. % manganese and about 0.10 to about 0.15 wt. % iron. In a most preferred embodiment, the sheet contains about 0.95 to about 1.35 wt. % silicon, about 0.04 to about 0.08 wt. % copper, about 0.02 to about 0.08 wt. % manganese and about 0.10 to about 0.15 wt. % iron.

In a second aspect of the invention, there is provided a method for producing an aluminum alloy sheet for forming comprising the steps of: casting an alloy ingot having the composition of the above-mentioned composition by a continuous casting or semicontinuous DC (direct chill) casting; homogenizing the alloy ingot at a temperature of from 450° to 613° C. for a period of from 1 to 48 hours; subsequently rolling until a requisite sheet thickness is obtained; holding the sheet at a temperature of from 450° to 613° C. for a period of at least 5 seconds, followed by rapidly quenching; and, aging at room temperature.

BRIEF DESCRIPTION OF THE DRAWING

Other features of the present invention will be further described in the following related description of the preferred embodiment which is to be considered together with the accompanying drawing wherein like figures refer to like parts and further wherein:

The FIGURE is a perspective view of the compositional ranges for the Si, Mg and Cu contents of the aluminum alloy sheet according to a preferred embodiment of the present invention.

DEFINITIONS

The term "sheet" as used broadly herein is intended to embrace gauges sometimes referred to as "plate" and "foil" as well as gauges intermediate plate and foil.

The term "ksi" shall mean kilopounds (thousand pounds) per square inch.

The term "minimum strength" shall mean the strength level at which 99% of the product is expected to conform with 95% confidence using standard statistical methods.

The term "ingot-derived" shall mean solidified from liquid metal by known or subsequently developed casting processes rather than through powder metallurgy or similar techniques. The term expressly includes, but shall not be limited to, direct chill (DC) continuous casting, slab casting, block casting, spray casting, electromagnetic continuous (EMC) casting and variations thereof.

The term "solution heat treat" is used herein to mean that the alloy is heated and maintained at a temperature sufficient to dissolve soluble constituents into solid solution where they are retained in a supersaturated state after quenching. The solution heat treatment of the present invention is such that substantially all soluble Si and $Mg_2Si$ second phase particles are dissolved into solid solution.

The term "rapidly quench" is used herein to mean cool the material at a rate sufficient that substantially all of the soluble constituents, which were dissolved into solution during solution heat treatment, are retained in a supersaturated state after quenching. The cooling rate can have a profound effect on the properties of the quenched alloy. Too slow a quench rate, such as that associated with warm water quench or misting water can cause elemental silicon or $Mg_2Si$ to come out of solution. Si or $Mg_2Si$ coming out of solution has a tendency to settle at the grain boundaries and has been associated with poor bending performance. Quench rates are considered to be rapid if they do not result in the appreciable precipitation of silicon or $Mg_2Si$ from solution. Spraying water on the aluminum sheet has been found to result in rapid quenching.

Hence, in accordance with the invention, the terms "formed panel" and "vehicular formed panel" as referred to herein in their broadest sense are intended to include bumpers, doors, hoods, trunk lids, fenders, fender wells, floors, wheels and other portions of an automotive or vehicular body. Such a panel can be fashioned from a flat sheet which is stamped between mating dies to provide a three-dimensional contoured shape, often of a generally convex configuration with respect to panels visible from the outside of a vehicle. The dual or plural panel members comprise two or more formed panels, an inside and an outside panel, the individual features of which are as described above. The inner and outer panels can be peripherally joined or connected to provide the dual or plural panel assembly, as shown in U.S. Pat. No. 4,082,578, the teachings of which are incorporated herein by reference. In some arrangements, two panels do not sufficiently strengthen the structure which can be reinforced by a third panel extending along or across all or a portion of the length or width of the structure. While the structure includes a peripheral joint or connection between the inner and outer panels, such joint or connection extends around peripheral portions and need not encompass the entire periphery. For instance, the peripheral joining can extend across the bottom, up both sides or ends and only but a short distance, if at all, from each end across the top. In addition, it is possible to connect the inner to outer panels via a third intermediary, or spacer, member. The dual or plural member structure can comprise one or more panels in the improved aluminum alloy wrought product although it is preferred that both panels be in the improved sheet product. On a less preferred basis, some embodiments contemplate in a structure comprising more than one panel, for instance two or more panels, one or more panels in the improved sheet product with the other panel, or panels, being formed from steel or perhaps another aluminum alloy.

The terms "automotive" or "vehicular" as used herein are intended to refer to automobiles, of course, but also to trucks, off-road vehicles, and other transport vehicles generally constructed in the general manner associated with automotive body or structural construction.

MODE FOR CARRYING OUT THE INVENTION

Turning first to the FIGURE, there is illustrated a perspective view of the range Si, Mg and Cu contents of the aluminum alloy sheet according to the present invention. The cubic area defined by points A–H illustrate the claimed area for the Si, Mg and Cu contents of the claimed alloys. Points A–D are all located on the 0.02 wt. % copper plane. Points E–H are all located on the 0.10 wt. % copper plane. The weight percent of Mg and Si for points A and E, B and F, C and G and D and H are the same.

In addition to Si, Mg and Cu, the alloys of the present invention also include Mn and Fe as essential components of the alloy. Each of the essential elements have a role that is performed synergistically as described below.

The Si strengthens the alloy due to precipitation hardening of elemental Si and $Mg_2Si$ formed under the co-presence of Mg. In addition to the effective strengthening, Si also effectively enhances the formability, particularly the stretching formability. When the Si content is less than about 0.8 wt. %, the strength is unsatisfactory. On the other hand, when the Si content exceeds about 1.5 wt. %, the soluble particles cannot all be put into solid solution during heat treatment without melting the alloy. Hence, the formability and mechanical properties of the resulting sheet would be degraded. The Si content is therefore set to be from about 0.8 to about 1.5 wt. %.

As is described above, Mg is an alloy-strengthening element that works by forming $Mg_2Si$ under the co-presence of Si. This result is not effectively attained at an Mg content of less than about 0.1 wt. %. Although Mg is effective in enhancing the strength of aluminum alloys, at higher levels and in amounts exceeding that needed for forming $Mg_2Si$, Mg reduces the formability of the alloy. The Mg content is therefore set to be from about 0.2 to about 0.65 wt. %.

Cu is an element which enhances the strength and formability of aluminum alloys. It is difficult to attain sufficient strength while maintaining or improving the formability only by the use of Mg and Si. Cu is therefore indispensable; however, Cu interferes with corrosion resistance of aluminum alloys. As will be described in greater detail below, it is desirable have some Cu in the alloy for purposes of strength and formability, but it is also desirable to maintain the Cu below about 0.1 wt. % to avoid creating corrosion resistance concerns. The Cu content is therefore set to be from about 0.01 to about 0.1 wt. %.

Fe refines the recrystallized grains and reduces or eliminates the alloys' susceptibility to a surface roughening phenomena known as orange peel. Therefore, Fe is desirable for grain structure control. However, too much Fe decreases the alloy's resistance to necking and/or fracture. The recrystallized grains coarsen at an Fe content of less than about 0.05 wt. %, and the formability is reduced at an Fe content exceeding 0.2 wt. %. The Fe content is therefore set to be from about 0.05 wt. % to about 0.2 wt. %. Preferably, the Fe content is below about 0.15 wt. %.

Mn also refines the recrystallized grains. Eliminating Mn from the alloy has been found to cause grain coarsening during heat treatment and subsequent orange peel during deformation. Hence, it is believed that, Mn forms dispersoids in the alloy which stabilizes its structure. Low levels of dispersoids enhance the formability of the alloy in equal biaxial stress states. However, it has been found that when the Mn exceeds 0.1 wt. %, the formability in the plane strain states is reduced. Consequently, although low levels of Mn are beneficial in preventing roughening during deformation and in improving formability in biaxial stress states, the amount of Mn in the alloy must be limited to prevent degradations to its plane strain formability. Plane strain formability has been found to be an important characteristic in the fabrication of large formed panels such as those used in automotive applications. It has been found that Mn is desirable up to levels of about 0.1 wt. %. The Mn content is therefore set to be from about 0.01 to about 0.1 wt. %.

The process for producing an aluminum alloy sheet according to the present invention is now explained.

The aluminum alloy ingot having a composition in the above-identified ranges is formed by an ordinary continuous casting or a semicontinuous DC casting method. The aluminum alloy ingot is subjected to homogenization to improve the homogeneity of solute and to refine the recrystallized grains of the final product. The effects of homogenizing are not properly attained when the heating temperature is less than 450° C. (842° F.). However, when the homogenizing temperature exceeds 613° C. (1135° F.), melting may occur. Homogenization temperatures must be maintained for a sufficient period of time to insure that the ingot has been homogenized.

After the ingot has been homogenized, it is brought to the proper rolling temperature and then rolled by an ordinary method to a final gauge. Alternatively, the ingot may be brought to room temperature following homogenization and then reheated to a proper rolling temperature prior to hot rolling. The rolling may be exclusively hot rolling or may be a combined hot rolling and subsequent cold rolling. Cold rolling is desired to provide the surface finish desired for autobody panels.

The rolled sheet is subjected to the solution heat treatment at a temperature of from 450° to 613° C. (842°–1133° F.), followed by rapid cooling (quenching). Preferably, the solution heat treatment is in the range of from about 860° to 1125° F. When the solution heat treatment temperature is less than 450° C. (842° F.), the solution effect is unsatisfactory, and satisfactory formability and strength are not obtained. On the other hand, when the solution treatment is more than 613° C. (1133° F.), melting may occur. A holding of at least 5 seconds is necessary for completing solutionizing. A holding of 30 seconds or longer is preferred. The rapid cooling after the holding at a solution temperature may be such that the cooling speed is at least equal to the forced air cooling, specifically 300° C./min or higher. As far as the cooling speed is concerned, water quenching is most preferable, forced air cooling, however, gives quenching without distortion. The solution heat treatment is preferably carried out in a continuous solution heat treatment furnace and under the following conditions: heating at a speed of 2° C./sec or more; holding for 5 to 180 seconds or longer, and cooling at a speed of 300° C./min or more. The heating at a speed of 2° C./sec or more is advantageous for refining the grains that recrystallize during solution heat treatment.

A continuous solution heat treatment furnace is most appropriate for subjecting the sheets, which are mass produced in the form of a coil, to the solution heat treatment and rapid cooling. The holding time of 180 seconds or longer is desirable for attaining a high productivity. The slower cooling speed is more advisable for providing a better flatness and smaller sheet distortion.

The higher cooling speed (>300° C./min) is more advisable for providing better formability and a higher strength. To attain a good flatness and no distortion, a forced air cooling at a cooling speed of 5° C./sec to 300° C./sec is preferable.

Also, between the hot rolling and solution heat treatment, an intermediate annealing treatment followed by cold rolling may be carried out to control grain size crystallographic texture and/or facilitate cold rolling. The holding temperature is preferably from 343° to 500° C., more preferably from 370° to 400° C., and the holding time is preferably from 0.5 to 10 hours for the intermediate annealing. The intermediate annealed sheet of aluminum alloy is preferably cold rolled at a reduction rate of at least 30%, and is then solution heat treated and rapidly quenched.

When the temperature of the intermediate annealing is less than 300° C., the recrystallization may not be complete, and grain growth and discoloration of the sheet surface occur when the temperature of intermediate annealing is higher than 500° C. When the intermediate annealing time is less than 0.5 hour, a homogeneous annealing of coils in large amounts becomes difficult in a box-type annealing furnace. On the other hand, an intermediate annealing of longer than 10 hours tends to make the process not economically viable. When the solution heat treatment is carried out in a continuous solution heat treatment furnace, the intermediate annealing temperature is preferably from 300° to 350° C. At an intermediate annealing temperature higher than 350° C., the $Mg_2Si$ phase coarsens and solutionizing is completed within 180 seconds only with difficulty. A cold-rolling at a reduction of at least 30% must be interposed between the intermediate annealing and solution heat treatment to prevent the grain growth during the solution heat treatment.

After forming, the painting and baking or T6 treatment may be carried out. The baking temperature is ordinarily from approximately 150° to 250° C.

The aluminum alloy rolled sheet according to the present invention is most appropriate for application as hang-on panels on an automobile body and can also exhibit excellent characteristics when used for other automobile parts, such as a heat shield, an instrument panel and other so-called "body-in-white" parts.

The benefit of the present invention is illustrated in the following examples.

EXAMPLES 1–9

To demonstrate the practice of the present invention and the advantages thereof, aluminum alloy products were made having the compositions shown in Table 1. All nine of the alloys fall within the composition box shown in the FIGURE. The alloys were cast to obtain ingot and fabricated by conventional methods to sheet gauges. The ingots were homogenized between 1015° and 1025° F. for at least 4 hours and hot rolled directly thereafter to a thickness of 0.125 inch, allowed to cool to room temperature, intermediate annealed at about 800° F. for about 2 hours and then cold rolled to a final gauge of 0.040 inch (1 mm). The sheet was examined prior to solution heat treatment, and significant amounts of soluble Si and $Mg_2Si$ second phase particles were found to be present.

Additional sheets were solution heat treated in the range of 1015° F. and rapidly quenched using cold water. The sheets were then naturally aged at room temperature for a period of two weeks. The alloys were examined, and it was found that substantially all of the Si and $Mg_2Si$ second phase particles remained in the solid solution in a supersaturated state.

TABLE 1

| Example | Si | Mg | Cu | Fe | Mn |
|---|---|---|---|---|---|
| 1 | 1.28 | 0.20 | 0.00 | 0.13 | 0.04 |
| 2 | 1.28 | 0.56 | 0.01 | 0.13 | 0.04 |
| 3 | 0.88 | 0.20 | 0.00 | 0.13 | 0.04 |
| 4 | 0.87 | 0.56 | 0.00 | 0.13 | 0.04 |
| 5 | 1.25 | 0.19 | 0.20 | 0.13 | 0.05 |
| 6 | 1.25 | 0.58 | 0.20 | 0.13 | 0.05 |
| 7 | 0.90 | 0.19 | 0.19 | 0.14 | 0.05 |
| 8 | 0.91 | 0.55 | 0.19 | 0.14 | 0.05 |
| 9 | 1.11 | 0.39 | 0.10 | 0.12 | 0.05 |
| 10 (AA6016) | 1.09 | 0.38 | 0.06 | 0.30 | 0.06 |
| 11 (AA2028) | 0.62 | 0.38 | 0.94 | 0.14 | 0.06 |

EXAMPLE 10

For comparison purposes, an AA6016 alloy sheet having the composition of Example 10 shown in Table 1 was tested. The material of Example 10 is a commercially available material which was formed into sheet using standard commercial practice. AA6016 is the current benchmark aluminum automotive alloy in that it has the best combination of T4 formability, T6 strength and T6 corrosion resistance. Like alloys of Examples 1–9, the alloy of Example 10 falls within the compositional box shown in the FIGURE. However, the alloy of Example 10 has an iron level which is outside the broadest range for Fe of the present invention. In addition, the alloy of Example 10 did not receive the rapid quench. The sheet was examined, and significant amounts of soluble second phase particles were found to be present. As stated above, the presence of soluble second phase particles, such as elemental Si and $Mg_2Si$, have been associated with poor bending performance.

EXAMPLE 11

For comparison purposes, an AA2008 alloy having the composition of Example 11 shown in Table 1 was made into sheet. AA2008 is a commercially available alloy for automotive applications and is the current benchmark for formability. The ingot was given a two-step preheat (5 hours at 935° F. and 4 hours at 1040° F.) to homogenize the ingot and processed as in Examples 1–9 except that the solution heat treat temperature was 950° F. The resulting sheet was examined, and it was found that substantially all of the Si and $Mg_2Si$ second phase particles remained in solution after quenching. Unlike alloys of Examples 1–10, the alloy of Example 11 falls outside the compositional box shown in the FIGURE.

EXAMPLES 12–23

The alloys of Examples 1–11 were aged naturally at room temperature. After at least one month of natural aging, the materials were tested to determine the mechanical properties and formability. The results are shown in Table 2.

The Limiting Dome Height (LDH) minimum point (plane strain) procedure establishes the dome height of samples formed over a four-inch hemispherical punch. LDH reflects the effects of strain hardening characteristics and limiting strain capabilities.

The 90° Guided Bend Test (GBT) is a substantially frictionless downflange test to estimate if an alloy can be flat hemmed. In the 90° GBT, a strip is rigidly clamped and then forced to bend 90° over a die radius by a roller. The test is repeated with progressively smaller die radii until fracture occurs. The smallest die radius (R) resulting in a bend without fracture is divided by the original sheet thickness (t) to determine the minimum R/t ratio. Materials which exhibit minimum R/t values less than about 0.5 are generally considered to be flat hem capable. Those exhibiting minimum R/t values in the range of about 0.5 to about 1.0 are considered to be marginal and materials with minimum R/t values greater than about 1.0 are not flat hem capable.

TABLE 2

| Example No. | Alloy of Example No. | Transverse Yield Strength (ksi) | Transverse Tensile Elongation (%) | Average N* | Transverse Uniform Elongation (%) | Longitudinal Guided Bend (min. R/t) | Hydraulic Bulge Strain (%) | Hydraulic Bulge Height (mm) |
|---|---|---|---|---|---|---|---|---|
| 12 | 1 | 12.7 | 27.0 | 0.291 | 24.0 | 0.195 | 50.5 | 2.69 |
| 13 | 2 | 22.0 | 28.0 | 0.294 | 25.1 | 0.198 | 50.5 | 2.65 |
| 14 | 3 | 9.7 | 26.2 | 0.295 | 23.6 | 0.195 | 32.8 | 2.29 |
| 15 | 4 | 18.6 | 27.5 | 0.254 | 22.9 | 0.184 | 47.1 | 2.60 |
| 16 | 5 | 13.6 | 28.0 | 0.306 | 25.7 | 0.186 | 46.6 | 2.61 |
| 17 | 6 | 23.0 | 27.0 | 0.252 | 24.9 | 0.505 | 52.0 | 2.71 |
| 18 | 7 | 11.2 | 25.2 | 0.304 | 23.5 | 0.000 | 41.7 | 2.46 |
| 19 | 8 | 19.4 | 27.2 | 0.260 | 24.5 | 0.198 | 51.8 | 2.70 |
| 20 | 9 | 17.8 | 26.8 | 0.267 | 25.2 | 0.311 | 48.3 | 2.58 |
| 21 | 10 (AA6016) | 20.3 | 28.3 | 0.214 | 21.4 | 0.848 | | |
| 22 | 11 (AA2008) | 17.0 | 28.5 | 0.296 | 24.4 | | | |
| 23 | 11** (AA2008) | 16.5 | 29.5 | 0.293 | 24.2 | | | |

*Average N is the average strain hardening exponent which was determined in the longitudinal, transverse and 45° angles to the rolling direction

**alloy annealed for 2 hours at 800° F. after hot rolling but before cold rolling Surprisingly, the formability of alloys of Examples 1–9 was significantly better than the AA6016 alloy of Example 10, as indicated by formability indicator parameters such as the average N values and the transverse uniform elongation values. Unexpectedly, the longitudinal guided bend test for all of the alloys of Examples 1–9 was significantly better than the AA6016 alloy of Example 10 (see Example 20). The guided bend values shown for the alloys of Examples 1–9 indicate that these materials would be "flat-hem capable", a stringent requirement of manufacturers of automobile aluminum outer panels. Conversely, the flat hem capability of the alloy of Example 10 (AA6016) is marginal. The formability and bend tests illustrate the criticality of dissolving the second phase Si and $Mg_2Si$ particles into solution and maintaining them in solution via a rapid quench.

In addition, the alloys of Examples 1–9 exhibited a better combination of transverse yield strength and formability than the alloys of Examples 22 and 23 (see Examples 13, 17 and 19). Furthermore, many of the alloys of Examples 1–9 exhibited formability characteristics which were similar to or superior to the AA2008 alloy of Example 11. This is surprising since AA2008 is considered to be one of the best forming heat-treatable alloys commercially available for automotive applications. Consequently, alloys which exhibit a better combination of strength and formability can be used in the fabrication of formed panels having more demanding shapes and still provide adequate resistance to handling damage.

EXAMPLES 24–33

In order to investigate the change in transverse tensile yield strength of the sheet after paint baking, the sheet of Examples 1–10 was stretched in plane strain by 2% and aged to a T62-type temper by heating the sheet for 20 minutes at 365° F. The results are shown in Table 3. Surprisingly, the materials of Examples 2, 6 and 8 (see Examples 25, 29 and 31 ) had a significantly higher tensile yield strength than the AA6016 material of Example 10 (see Example 33). Alloys such as these, which exhibit superior formability and strength combinations, enable more difficult parts to be formed as well as provide lightweighting and/or cost reduction opportunities via the use of thinner gauges.

TABLE 3

| Example No. | Alloy of Example No. | Transverse TYS* |
|---|---|---|
| 24 | 1 | 18.3 |
| 25 | 2 | 33.9 |
| 26 | 3 | 13.4 |
| 27 | 4 | 25.1 |
| 28 | 5 | 19.4 |
| 29 | 6 | 35.3 |
| 30 | 7 | 15.9 |
| 31 | 8 | 27.9 |
| 32 | 9 | 24.7 |
| 33 | 10 (AA6016-T62) | 25.1 |

*measured at room temperature after aging at 365° F. for 20 minutes

EXAMPLES 34–45

In order to investigate the change in transverse tensile yield strength of the sheet after paint baking at a lower temperature, the sheet of Examples 1–10 was stretched in plane strain by 2% and aged by heating for 30 minutes at 350° F. The results are shown in Table 4. Surprisingly, the materials of Examples 2, 6 and 8 (see Examples 35, 39 and 41) again exhibited significantly higher tensile yield strength than the material of Example 10. Hence, even if aging is conducted at a lower temperature than desired, the alloys of Examples 2, 6 and 8 continue to provide resistance to denting and/or lightweighting opportunities.

In addition, the corrosion resistance of the sheet was determined using a standard durability test ASTM G110. The results are shown in Table 4. All of the alloys which exhibited only pitting (including the materials of Examples 2 and 6) were judged superior to the material of Example 10 (AA6016) and two other commercial automotive alloys (see Examples 44 and 45) which exhibited intergrannular types of attack. Intergrannular corrosion attack penetrates deeper into a given material and can result in the degradation of mechanical properties following corrosion.

TABLE 4

| Example No. | Alloy of Example No. | Transverse TYS** | Corrosion Resistance* | Depth of Attack |
|---|---|---|---|---|
| 34 | 1 | 17.9 | P | IN |
| 35 | 2 | 30.0 | P | IN |
| 36 | 3 | 13.9 | — | — |
| 37 | 4 | 24.3 | P | IN |
| 38 | 5 | 18.9 | P & IG | 0.0014 |
| 39 | 6 | 31.7 | P | 0.0003 |
| 40 | 7 | 15.8 | — | — |
| 41 | 8 | 26.5 | P & IG | 0.0013 |
| 42 | 9 | 24.1 | P | 0.0005 |
| 43 | 10 | 23.9 | P & IG | 0.0016 |
| 44 | 6111-T62 | (0.75% Cu) | P & IG | 0.0020 |
| 45 | 6009-T62 | (0.35% Cu) | P & IG | 0.0036 |

*P = pitting
IG = intergrannular corrosion
IN = insignificant
**measured at room temperature after aging for 30 minutes at 350° F.

EXAMPLES 46–56

In order to investigate the change in transverse tensile yield strength of sheet in the T62 temper after paint baking, the sheet of Examples 1–11 was heated for 60 minutes at 400° F. The results are shown in Table 5. Once again, the materials of Examples 2, 6 and 8 (see Examples 47, 51 and 59) were significantly stronger than the commercial composition of Example 10.

TABLE 5

| Example No. | Alloy of Example No. | Transverse Tensile Yield Strength* |
|---|---|---|
| 46 | 1 | 26.1 |
| 47 | 2 | 43.7 |
| 48 | 3 | 21.2 |
| 49 | 4 | 40.9 |
| 50 | 5 | 26.3 |
| 51 | 6 | 44.8 |
| 52 | 7 | 22.0 |
| 53 | 8 | 42.9 |
| 54 | 9 | 36.7 |
| 55 | 10 (AA6016) | 33.9 |
| 56 | 11 (AA2008) | 36.0 |

*measured at room temperature after aging at 400° F. for 1 hour

EXAMPLES 57 and 58

In order to investigate a change in the processing on the properties and characteristics of the sheet, an alloy having the composition of Example 9, which is the center of the parallelogram of the FIGURE, was processed without an intermediate anneal for 2 hours at 800° F. The materials in the previous examples were processed with an intermediate anneal except for the AA6016 material of Example 10. The processing conditions for Examples 57 and 58 are shown in Table 6, and the resulting properties and characteristics of the sheet are shown in Table 7.

TABLE 6

| Example No. | Alloy of Example No. | Intermediate Anneal °F. |
|---|---|---|
| 57 | 9 | Yes |
| 58 | 9 | No |

TABLE 7

| Example No. | Alloy of Example No. | Transverse Yield Strength (ksi) | Transverse Tensile Elongation (%) | Longitudinal Uniform Elongation (%) | Longitudinal Guided Bend (min R/t) | Limiting Dome Longitudinal | Dome Height Transverse |
|---|---|---|---|---|---|---|---|
| 57 | 9 | 17.8 | 26.8 | 25.6 | 0.424 | 0.977 | 1.038 |
| 58 | 9 | 17.6 | 29.0 | 26.8 | 0.000 | 1.029 | 1.024 |

From Table 7, it is clear that the yield strengths are similar but the material which did not receive the anneal possessed superior properties and isotropic characteristics compared to the material which received the anneal. For instance, the transverse tensile elongation and longitudinal limiting dome height tests reveal the most significant differences in performance between the two examples. Specifically, the sample processed without the anneal (Example 58) exhibits greater elongations, stretching capability (limiting dome height) and bending performance (guided bend). Furthermore, the sample processed without the intermediate anneal was more isotropic, i.e., it exhibited less variation in properties due to orientation. The significance of Examples 57 and 58 is that the values obtained in the earlier examples which used the materials of Examples 1–9 could be even further improved over existing commercial automotive alloys since these samples were fabricated with the intermediate anneal which degraded the materials' performance.

EXAMPLES 59–62

To demonstrate the benefit of iron and manganese in the practice of the invention and the advantages thereof, aluminum alloy products were fabricated as before having the compositions shown in Table 8. The compositions of Examples 59 and 60 were designed to show the benefit of maintaining both the iron and manganese levels. Examples 61 and 62 demonstrate the effect of increasing the iron levels within the preferred range.

The sheet products were tested to determine the mechanical properties and formability. The results are shown in Table 9. The higher iron-containing alloys exhibited lower formability values than similar alloys with lower amounts of iron (see Examples 59–62) as indicated by higher average N values, the longitudinal uniform elongation values, transverse stretch bend values and bulge height measurement.

TABLE 8

| Example No. | Si | Mg | Cu | Fe | Mn |
|---|---|---|---|---|---|
| 59 | 0.79 | 0.58 | 0.32 | 0.16 | 0.04 |
| 60 | 0.73 | 0.47 | 0.35 | 0.35 | 0.34 |
| 61 | 0.83 | 0.22 | 0.95 | 0.18 | 0.04 |
| 62 | 0.85 | 0.26 | 0.95 | 0.09 | 0.05 |
| 63 | 0.97 | 0.43 | 0.47 | 0.09 | 0.00 |
| 64 | 0.85 | 0.26 | 0.95 | 0.09 | 0.05 |

TABLE 9

| Test | Example No. 59 | 60 | 61 | 62 |
|---|---|---|---|---|
| Longitudinal Tensile Elongation (%) | 25.2 | 23.5 | 23.8 | 25.0 |
| Longitudinal Strain Hardening Exp-N | 0.237 | 0.214 | 0.222 | 0.261 |
| Longitudinal Uniform Elongation (%) | 24.9 | 20.4 | 23.7 | 24.0 |
| Longitudinal LDH (Absolute Height - in.) | 1.010 | 0.900 | 0.960 | 1.023 |
| Longitudinal LDH (Adjusted Value - in.) | 0.980 | 0.880 | | |
| Transverse Guided Bend | 0.671 | 0.655 | | |
| Longitudinal Guided Bend | 0.478 | 0.374 | | |
| Longitudinal Stretch Bend - H/t | 34.0 | 27.2 | 31.8 | 36.2 |
| Transverse Stretch Bend - H/t | 32.6 | 26.7 | | |
| Bulge Height | 47.7 | 43.6 | 44.6 | 46.6 |

EXAMPLES 63 and 64

To demonstrate the importance of the presence of manganese in the practice of the present invention, aluminum alloy products were fabricated as before having the compositions shown in Table 8. The ASTM grain size and number of grains per $mm^3$ was optically determined. The values are listed in Table 10.

TABLE 10

| Example No. | ASTM Grain Size | Number of Grains (per $mm^3$) |
|---|---|---|
| 63 | 2.0–3.0 | 381 |
| 64 | 3.0–4.0 | 1908 |

From Table 10, it is clear that Example 63, which contained no manganese, had less than 25% of the number of grains per $mm^3$ than Example 64. Since coarser grain sizes typically can cause orange peel to occur during deformation, it is desirable to maintain some low level of Mn in the material.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A process for forming an aluminum alloy rolled sheet particularly suitable for use for an automotive body member, said process comprising:

(a) providing a body of an alloy comprising:
about 0.8 to about 1.5 wt. % silicon,
about 0.5 to about 0.65 wt. % magnesium,
about 0.01 to about 0.09 wt. % copper,
about 0.01 to about 0.1 wt. % manganese,
about 0.05 to about 0.2 wt. % iron, and the balance being substantially aluminum and incidental elements and impurities;

(b) working said body to produce said sheet;

(c) solution heat treating said sheet;

(d) rapidly quenching said sheet; and (e) naturally aging said sheet for at least one day prior to forming into an automotive body member.

2. The method of claim 1 in which said alloy contains:

about 0.95 to about 1.35 wt. % silicon, about 0.5 to about 0.6 wt. % magnesium, about 0.04 to about 0.08 wt. % copper, about 0.02 to about 0.08 wt. % manganese, and about 0.10 to about 0.1 wt. % iron.

3. The method of claim 1 in which (a) further includes:

about 0.9 to about 1.3 wt. % silicon.

4. The method of claim 1 in which (a) further includes:

about 0.04 to about 0.08 wt. % manganese.

5. The method of claim 1 in which (b) includes:

a plurality of separate working steps without an intermediate anneal between descrete working steps.

6. The method of claim 1 in which (c) includes:

solution heat treating said sheet in the temperature range of about 842° to 1133° F.

7. The method of claim 1 in which (c) includes:

solution heat treating said sheet in the temperature range of about 860° to 1125° F.

8. The method of claim 1 in which (d) further includes:

rapid water quenching.

9. An aluminum alloy suitable for use for an automotive body, said alloy comprising:

about 0.8 to about 1.5 wt. % silicon, about 0.5 to about 0.65 wt. % magnesium, about 0.01 to about 0.09 wt. % copper, about 0.01 to about 0.1 wt. % manganese, about 0.05 to about 0.2 wt. % iron, and the balance being substantially aluminum and incidental elements and impurities.

10. The alloy of claim 9 which further includes:

about 0.95 to about 1.35 wt. % silicon, about 0.5 to about 0.6 wt. % magnesium, about 0.04 to about 0.08 wt. % copper, about 0.02 to about 0.08 wt. % manganese, and about 0.10 to about 0.15 wt. % iron.

11. The alloy of claim 9 which further includes:

about 0.9 to about 1.3 wt. % silicon.

12. The alloy of claim 9 which further includes:

about 0.04 to about 0.08 wt. % manganese.

13. An aluminum alloy sheet having improved formability, strength and corrosion resistance suitable for forming into automotive body members, said aluminum alloy comprising:

about 0.8 to about 1.5 wt. % silicon, about 0.5 to about 0.65 wt. % magnesium, about 0.01 to about 0.09 wt. % copper, about 0.01 to about 0.1 wt. % manganese, about 0.05 to about 0.2 wt. % iron, and the balance being substantially aluminum and incidental elements and impurities; said alloy being produced by casting an ingot of the alloy, homogenizing the ingot, hot rolling the ingot to produce a slab, cold rolling said slab to produce sheet, solution heat treating said sheet, rapidly quenching said sheet and naturally aging said sheet for at least one day prior to forming into an automotive body member.

14. The aluminum alloy sheet of claim 13 which further includes:

about 0.95 to about 1.35 wt. % silicon, about 0.5 to about 0.6 wt. % magnesium, about 0.04 to about 0.08 wt. % copper, about 0.02 to about 0.08 wt. % manganese, and about 0.10 to about 0.15 wt. % iron.

15. The aluminum alloy sheet of claim 13 which further includes:

about 0.9 to about 1.3 wt. % silicon.

16. The aluminum alloy sheet of claim 13 which further includes:

about 0.04 to about 0.08 wt. % manganese.

17. A formed vehicular panel comprising a formed and age hardened article of aluminum alloy sheet, said aluminum alloy comprising:

about 0.8 to about 1.5 wt. % silicon, about 0.5 to about 0.65 wt. % magnesium, about 0.01 to about 0.09 wt. % copper, about 0.01 to about 0.1 wt. % manganese, about 0.05 to about 0.2 wt. % iron, and the balance being substantially aluminum and incidental elements and impurities; said alloy being produced by casting an ingot of the alloy, homogenizing the ingot, hot rolling the ingot to produce a slab, cold rolling said slab to produce sheet, solution heat treating said sheet, quenching, naturally aging said sheet for at least one day prior to forming and forming into a vehicular panel.

18. The formed vehicular panel of claim 17 which further includes:

about 0.95 to about 1.35 wt. % silicon, about 0.5 to about 0.6 wt. % magnesium, about 0.04 to about 0.08 wt. % copper, about 0.02 to about 0.08 wt. % manganese, and about 0.10 to about 0.15 wt. % iron.

19. The formed vehicular panel of claim 17 which further includes:

about 1.0 to about 1.5 wt. % silicon, about 0.5 to about 0.6 wt. % magnesium, and about 0.02 to about 0.09 wt. % copper.

20. The formed vehicular panel of claim 17 which further includes:

about 0.9 to about 1.3 wt. % silicon.

21. The formed vehicular panel of claim 17 which further includes:

about 0.04 to about 0.08 wt. % manganese.

22. The formed vehicular panel of claim 17 in which said aluminum alloy sheet is formed into an automotive door panel.

23. The formed vehicular panel of claim 17 in which said aluminum alloy sheet is formed into an automotive hood panel.

24. The formed vehicular panel of claim 17 in which said aluminum alloy sheet is formed into an automotive body panel.

25. An aluminum alloy suitable for use for an automotive body, said alloy comprising:

about 0.8 to about 1.5 wt. % silicon, about 0.5 to about 0.65 wt. % magnesium, about 0.04 to about 0.09 wt. % copper, about 0.01 to about 0.1 wt. % manganese, about 0.05 to about 0.2 wt. % iron, and the balance being substantially aluminum and incidental elements and impurities.

26. An aluminum alloy suitable for use for an automotive body, said alloy comprising:

about 0.8 to about 1.5 wt. % silicon, about 0.5 to about 0.65 wt. % magnesium, about 0.01 to about 0.09 wt. % copper, about 0.06 to about 0.1 wt. % manganese, about 0.05 to about 0.2 wt. % iron, and the balance being substantially aluminum and incidental elements and impurities.

27. An aluminum alloy suitable for use for an automotive body, said alloy comprising:

about 0.8 to about 1.5 wt. % silicon, about 0.5 to about 0.65 wt. % magnesium, about 0.01 to about 0.09 wt. % copper, about 0.01 to about 0.1 wt. % manganese, about 0.09 to about 0.2 wt. % iron, and the balance being substantially aluminum and incidental elements and impurities.

28. An aluminum alloy suitable for use for an automotive body, said alloy comprising:

about 0.8 to about 1.5 wt. % silicon, about 0.5 to about 0.65 wt. % magnesium, one or more of:

about 0.01 to about 0.09 wt. % copper,
about 0.01 to about 0.1 wt. % manganese, and
about 0.09 to about 0.2 wt. % iron, and the balance being substantially aluminum and incidental elements and impurities.

29. A process for forming an aluminum alloy rolled sheet particularly suitable for use for an automotive body member, said process comprising:

(a) providing a body of an alloy comprising:
about 0.8 to about 1.5 wt. % silicon,
about 0.5 to about 0.65 wt. % magnesium,
about 0.01 to about 0.09 wt. % copper,
about 0.01 to about 0.1 wt. % manganese,
about 0.05 to about 0.2 wt. % iron, and the balance being substantially aluminum and incidental elements and impurities;

(b) working said body to produce said sheet;

(c) solution heat treating said sheet; and (d) rapidly quenching said sheet.

* * * * *